US005482177A

United States Patent [19]

Keller

[11] Patent Number: 5,482,177

[45] Date of Patent: Jan. 9, 1996

[54] CLOSURE ON A CARTRIDGE

[76] Inventor: Wilhelm A. Keller, Obstgartenweg 9, CH-6402 Merlischachen, Switzerland

[21] Appl. No.: 155,763

[22] Filed: Nov. 23, 1993

[30] Foreign Application Priority Data

Nov. 23, 1992 [EP] European Pat. Off. ..... 92810907

[51] Int. Cl.[6] ..... B65D 51/22

[52] U.S. Cl. ..... 220/278; 215/226; 215/257; 215/303; 220/258; 222/85

[58] Field of Search ..... 215/226, 228, 215/257, 295, 303, 321; 220/212, 258, 277, 278; 206/222; 222/81, 83, 85, 86

[56] References Cited

U.S. PATENT DOCUMENTS 3,931,905 1/1976 Shumway et al. ..... 220/278
4,307,821 12/1981 McIntosh ..... 222/83
4,884,703 12/1989 O'Meara ..... 215/6
4,974,756 12/1990 Pearson et al. .
4,986,443 1/1991 Saur et al. .

FOREIGN PATENT DOCUMENTS 0326641 8/1989 European Pat. Off. .
0355471 2/1990 European Pat. Off. .

*Primary Examiner*—Gary E. Elkins
*Attorney, Agent, or Firm*—Marks & Murase

[57] ABSTRACT

A closure of a double cartridge for a dispensing appliance comprises piercing members for piercing a membrane provided on the outlet openings of the cartridge, the piercing members including two stoppers which are tapered at their front sides. With the closure, it is possible when using the cartridge to pierce the membrane without searching for a suitable object and to reuse the cartridge without soiling.

10 Claims, 2 Drawing Sheets

CLOSURE ON A CARTRIDGE

BACKGROUND OF THE INVENTION

The present invention refers to a closure on a cartridge, particularly intended for a double cartridge. Generally, dispensing cartridges are sealed at the dispensing end with some kind of closure or stopper which is removed when the cartridge is to be used. In order to dispense a substance by means of a dispensing appliance, an attachment is generally secured to the cartridge, the attachment being a static mixer in the case of double cartridges. The cartridge outlet is often sealed by a membrane or a foil which must be pierced in some way for use. Although objects of some kind for piercing the membrane may be present at the site where such cartridges or dispensing appliances are used, the objects nevertheless have to be previously provided. Moreover, if the cartridge is not completely emptied after its use, or if it is to be used again, there is a risk that the substance spills out of the pierced opening(s) of the cartridge and causes contaminations which may result in olfactory or skin irritations.

SUMMARY OF THE INVENTION

On this background, it is an object of the present invention to provide a closure which avoids the search for an object for piercing the foil or membrane, on one hand, and which allows a disturbance-free multiple use of the cartridge without the risk of contaminations or an undesired mixing of the components at the dispensing end, on the other hand. This object is attained by means of a closure on a multiple cartridge, the closure comprising means for piercing a membrane or a foil provided on the dispensing openings. A preferred embodiment prevents an undesired mixing of two components of a cartridge.

The invention is explained in more detail hereinafter with reference to a drawing of an embodiment.

SHORT DESCRIPTION OF THE INVENTION

DETAILED DESCRIPTION OF THE INVENTION

Figure 1:
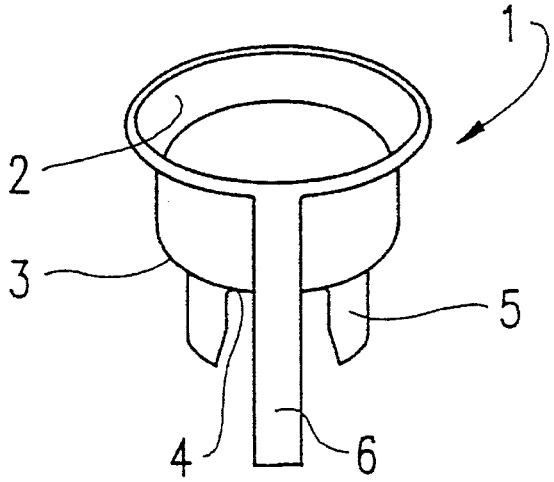
FIG. 1 shows a closure of the invention in a perspective view.
Figure 2:
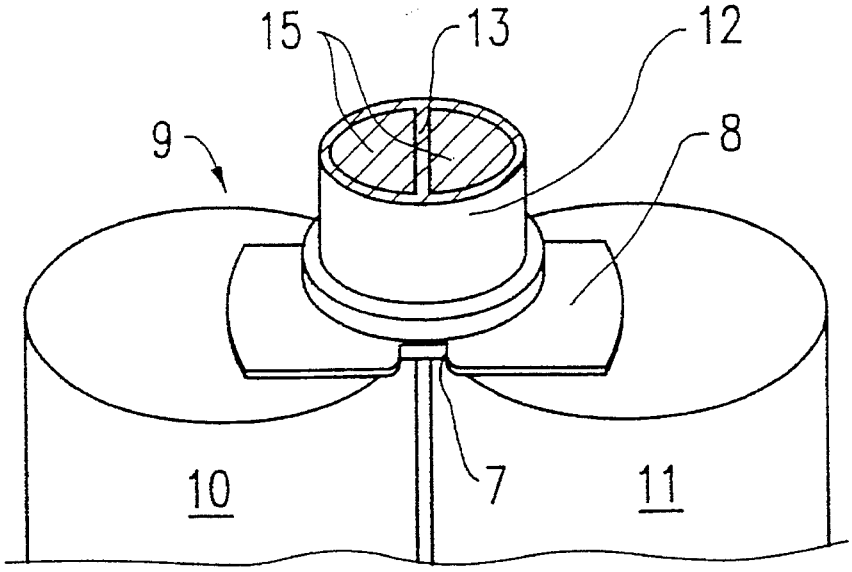
FIG. 2 shows a dispensing end of a double cartridge.

The embodiment of FIGS. 1 and 2 is a closure for a double cartridge having two equal storage cylinders, but the description will show that the invention is appropriate for a closure for a multiple cartridge as well, and also for double or multiple cartridges having storage cylinders of different volumes, (eg. different cross-sectional areas).

Closure 1 comprises a circular collar 2 and a closure sleeve 3. On the front side 4 facing the inside of the cartridge, two stoppers 5 are arranged whose front side is slightly tapered in order to be capable of piercing a membrane or a plastics or metal foil.

In order to exclude that the components adhering to the stoppers 5 come into contact with each other when the closure is placed or replaced on double or multiple cartridges, it is necessary that the closure be insertable in only one determined position. One means to align the closure with respect to the cartridge consists in a ledge 6 at the closure which engages in a recess 7 of the cartridge, e.g. in flange 8 of the cartridge.

As appears in FIG. 1, collar 2 and ledge 6 not only have the functions of serving as a handle portion and guide, but the additional purpose of preventing that the substance adhering to the stoppers comes into contact with a working surface and thus soils the latter and thereby the stoppers as well. To this end, the outer diameter of the collar and the length of the ledge must have suitable dimensions.

Figure 3:
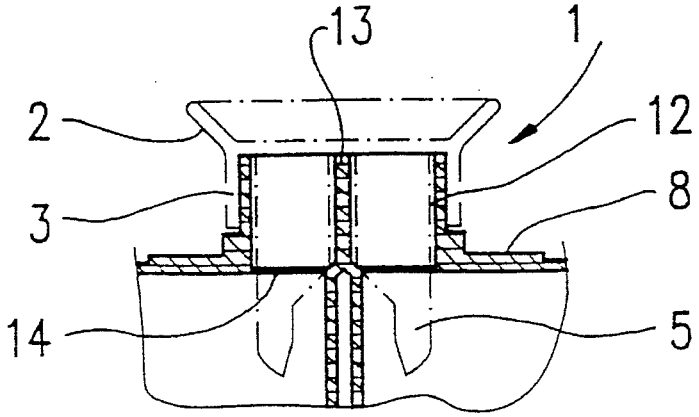
FIG. 3 shows a cross-section of an alternative embodiment of a cartridge dispensing end with the closure of FIG. 1
Figure 4:
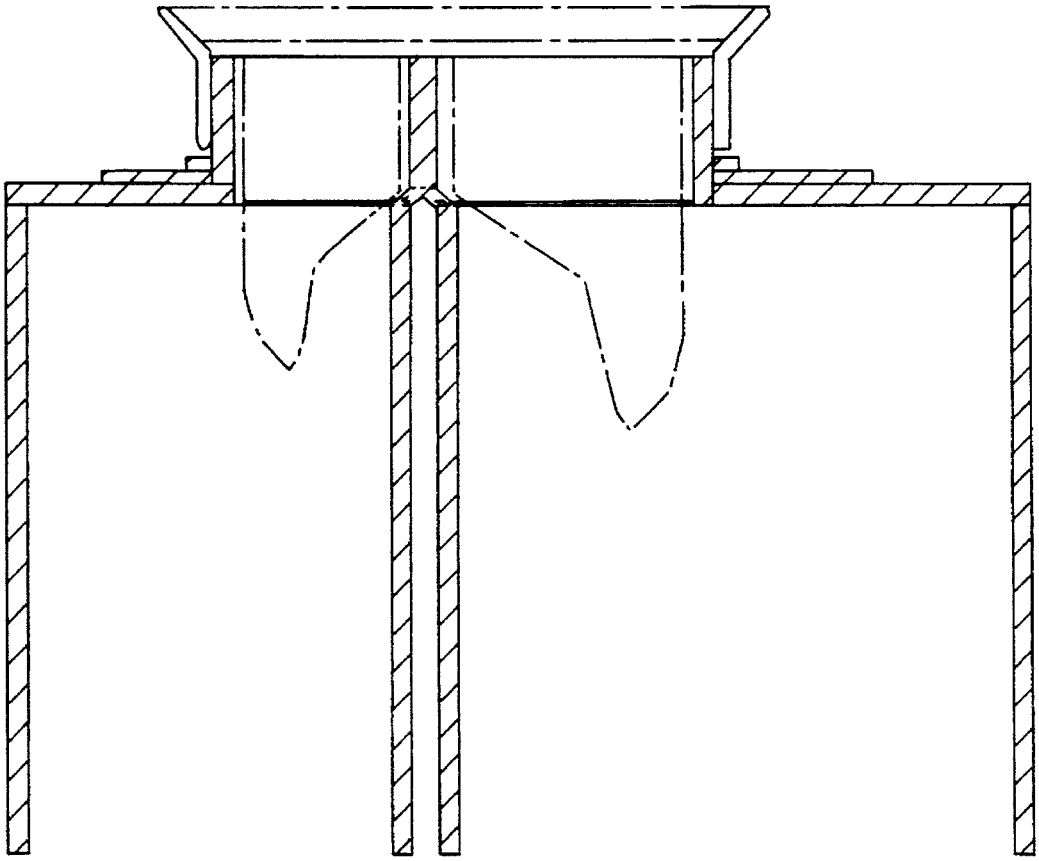
FIG. 4 shows a dispensing end of a double cartridge having different sized storage cylinders.

In the present case, cartridge 9 is formed of two storage cylinders 10 and 11 of the same size (FIG. 2) or two storage cylinders 10' and 11' of different sizes (FIG. 4). The storage cylinders have outlet openings which end in a common outlet nozzle 12 which is partitioned by a center web 13. The outlet openings according to FIG. 3 may either be provided with a membrane 14 already in the process of injection-molding the cartridge, or the outlet openings are closed by means of a plastics or metal foil 15 after filling the cartridge.

In order to replace closure 1, closure sleeve 3 is dimensioned in such a manner that it encloses outlet nozzles 12 while stoppers 5 engage in outlet nozzle 12 to seal the outlet openings tightly, as appears in FIG. 3. The closure is suitably included with the cartridge, e.g. in a blister package.

As already mentioned in the introduction, the closure of the invention is not only intended for double cartridges, but also for multiple cartridges where the number of stoppers depends on the number of storage cylinders, each of the cylinders being sealed by a foil or a membrane. With respect to the orienting means, e.g. projections of different sizes at the closure engaging in corresponding recesses of the cartridge are possible, or different dimensions or shapes of the stoppers with correspondingly shaped outlet openings of the cartridge.

I claim:

1. In combination, a closure and a multiple cartridge, said multiple cartridge comprising a plurality of dispensing openings and a membrane for covering said dispensing openings, said closure comprising means for piercing the membrane adjacent each dispensing opening when said closure is placed over the dispensing openings and an orienting means for placing said closure over the dispensing openings in only one predetermined position;

wherein said orienting means consist of stoppers having different dimensions and of correspondingly dimensioned dispensing openings of said cartridge.

2. The closure and multiple cartridge combination of claim 1, wherein said piercing means comprise at least two stoppers having tapered ends for piercing said membrane.

3. The closure and multiple cartridge combination of claim 1, further comprising a closure sleeve enclosing an outlet nozzle containing said dispensing openings.

4. The closure and multiple cartridge combination of claim 1, further comprising a circular collar formed on said closure, said circular collar having an external diameter which, together with said ledge, prevent said stoppers from touching a working surface when said closure is lying on the working surface with the circular collar and ledge in engagement with the working surface.

5. The closure and multiple cartridge combination of claim 1, wherein each dispensing opening is provided with a membrane which is produced in a process of injection-molding said cartridge.

6. The closure and multiple cartridge combination of claim 1, wherein each dispensing opening is provided with a membrane formed of plastic.

7. The closure and multiple cartridge combination of claim 1, wherein each dispensing opening is provided with a membrane formed of metal foil.

8. The closure and multiple cartridge combination of claim 1, wherein said plurality of dispensing openings end in a common cylindrical outlet nozzle of said multiple cartridge, said outlet nozzle being partitioned by a center web to separate material dispensed from respective storage cylinders of said multiple cartridge.

9. In combination, a closure and a multiple cartridge, said multiple cartridge comprising a plurality of dispensing openings and a membrane for covering said dispensing openings, said closure comprising means for piercing the membrane adjacent each dispensing opening when said closure is placed over the dispensing openings and an orienting means for placing said closure over the dispensing openings in only one predetermined position;

wherein said multiple cartridge has a plurality of storage cylinders having different volumes and cross-sectional areas.

10. In combination, a closure and a multiple cartridge, said multiple cartridge comprising a plurality of dispensing openings and a membrane for covering said dispensing openings, said closure comprising means for piercing the membrane adjacent each dispensing opening when said closure is placed over the dispensing openings and an orienting means for placing said closure over the dispensing openings in only one predetermined position;

wherein said orienting means consist of stoppers having different respective geometries and of correspondingly shaped dispensing openings of said cartridge.

* * * * *